US005451025A

United States Patent [19]

Hames

[11] Patent Number: 5,451,025

[45] Date of Patent: Sep. 19, 1995

[54] DOCUMENT COPY HOLDER

[75] Inventor: Edward L. Hames, Peterborough, N.H.

[73] Assignee: Curtis Manufacturing Company, Inc., Jaffrey, N.H.

[21] Appl. No.: 257,364

[22] Filed: Jun. 9, 1994

[51] Int. Cl.[6] ..... A47G 1/24

[52] U.S. Cl. ..... 248/456; 248/452; 248/457

[58] Field of Search ..... 248/456, 455, 454, 457, 248/460, 463, 464, 452, 451; 400/718

[56] References Cited

U.S. PATENT DOCUMENTS

| | | | |
|---|---|---|---|
| 344,770 | 6/1969 | Gallamos | 248/456 X |
| 3,410,516 | 11/1968 | Criswall | 248/463 X |
| 4,460,146 | 7/1984 | Raggiotti | 248/456 |
| 4,902,078 | 2/1990 | Judd | 248/442.2 X |
| 5,052,650 | 10/1991 | Belle et al. | 248/456 X |
| 5,366,197 | 11/1994 | Westland | 248/456 |

*Primary Examiner*—Ramon O. Ramirez

*Attorney, Agent, or Firm*—Richard P. Crowley

[57] ABSTRACT

A document copy holder which comprises a copy holder panel stand, a document holder clip and a document line guide with .magnifying capabilities. The panel stand is a flat, generally rectangular surface with integral support legs and a hingeably secured support section cut out from the middle of the stand and extending outwardly to the back, with hingeably secured support legs connected by an inwardly extending ledge that is inserted into selected receiving holes at the back of the panel stand to provide for a desired inclined angle of use for the user. The document copy holder clip is positioned at the top of the panel stand to retain documents, and the document line guide is slidably secured to the panel stand at the sides to further retain documents and to provide for a line guide, and may also have magnification capabilities for easier reading. A screw mechanism on the line guide enables the user to adjust the line guide arm away from the panel stand surface and optionally to turn the line guide arm away from the panel stand entirely to adjust or replace documents.

17 Claims, 5 Drawing Sheets

DOCUMENT COPY HOLDER

BACKGROUND OF THE INVENTION

There are a wide variety of different document copy holders for positioning documents, such as printed materials, papers and books against a flat surface at an inclined position, so that a user may view the material while performing other tasks. The document copy holder is often useful in containing one or more pages of documents to permit reading of the documents or transcribing all or a part of the printed material of the document with a typewriter, word processor, or computer.

Typically, a document copy holder has a panel with a flat face surface against which the documents are received and retained and includes a lower edge at the bottom of the flat panel to retain documents, and includes on one side a line guide which extends transversely across the flat surface to aid a user in copying particular lines of the retained documents. The document copy holder also usually includes a clip or other document retaining means at the top thereof, to aid in securing the document flat against the flat surface of the panel. The document copy holder may also include a bracket or support stand, which may in use extend outwardly from the back surface of the flat panel to retain the document copy holder in a selected, inclined use position adjacent the work surface on which the document copy holder is employed.

One document copy holder for holding and positioning documents is described in U.S. Pat. No. 5,052,650, issued Oct. 1, 1991, which includes a spring loaded line guide, mounted on one side of a flat panel which contains the flat surface for holding and positioning documents, and includes a multi-position bracket extending outwardly from the back surface of the flat panel to retain the document copy holder in an inclined support position in use.

It is desired to provide for a new and improved document copy holder which is easily and effectively manufactured at low cost, which is composed substantially of plastic material, which is compact in the non-use position and can be readily moved into a variety of use positions.

SUMMARY OF THE INVENTION

The invention comprises a document copy holder for holding documents composed of one or multiple pages, which copy holder comprises a generally flat display panel stand composed of a plastic material, such as a moldable, hard, plastic material and having a face and back surface, a top and bottom and sides, and of a selected height and width to hold documents on the flat face surface, and typically of sufficient height and width to retain ordinary stationery or legal sized documents thereon, and optionally which is generally rectangular. The copy holder includes the panel stand, which is adapted to move between a compact, non-use position such as a horizontal position, and an inclined support position in use, inclined at a desired angle from a vertical position.

The copy holder includes a document holder clip disposed at the top of the panel stand and preferably slidably positioned on the top of the panel stand, to retain the upper portion of the documents onto the face surface of the panel stand. The copy holder also includes a line guide attached to one side of the panel stand and extending generally transversely across substantially the face surface of the panel stand and adapted to be moved generally slidably by a user with respect to the printed lines on the document held by the copy holder. The copy holder includes generally a short, outwardly extending ledge from the bottom of the panel stand which aids in retaining documents on the face surface of the panel stand.

The copy holder of the invention also includes a panel stand support section with two legs on either side of the support section, said legs connected by an outwardly extending ledge at the bottom and connected to the support section with hinges formed by plastic material, which enable the support section to move between a non-use position wherein it forms a part of the face surface of the panel stand and a support position where the support section extends outwardly and backwardly from the face surface of the panel stand, and the support section legs extend inwardly to enable the outwardly extending ledge on the bottom of the legs to be retained in slots on the back surface of the panel stand, to provide a support for the remaining portion of the panel stand at a selected inclined position.

The support section generally is a plastic, hinged, molded section of the panel stand with hinged, cut-out leg sections thereon, generally rectangular in form. The support section extends upwardly from the panel stand, and with the top having a hinge formed by the plastic material which forms the panel stand and the top of the two legs having plastic hinges formed in a similar manner. The hinges thus act, for example, as "living" plastic hinges, wherein the plastic is of a plastic material and has sufficient molecular construction, so that it may be moved repeatedly between a use and non-use position without weakening substantially the plastic hinges, thereby to provide for the movement of the support section and the support legs between the non-use position and a hinged support use position. The support section in use extends outwardly and backwardly from the back surface of the panel stand, generally slightly below the midpoint of the panel stand, and the support legs extending inwardly and forwardly toward one or more receiving slots in the back surface of the panel stand to support the panel stand in an inclined use position. The copy holder also includes a plurality of spaced apart slots on either side of the panel stand opening as part of the support stand to retain the hinged support legs of the cut-out section of the support stand in a selected multi-use position.

The document copy holder of the invention thus provides for the support section and support legs to be easily molded with or cut out as part of the paneled section forming the face surface, to provide for a very compact, document copy holder in the compact, non-use position, yet which provides for the support section to be easily, hingedly moved out, employing the plastic hinges forming the support section of the panel stand by the user.

The document copy holder is easily and effectively manufactured at low cost to provide for the panel stand with the support stand generally planar with the panel stand with a separate line guide means, which is easily assembled and inserted by the user onto one or the other side of the panel stand for slidable movement along the side. The stand also has a separate plastic biased clip which is slidably mounted on flanges on the top of the panel stand by the user for slidable transverse movement of the clip. The line guide also is composed substantially of plastic material, so that the component parts of the document copy holder are all molded plastic and may be easily placed in a single package and easily assembled for use by the user.

The hinged support stand section and support legs thereon of the copy holder employs two spaced-apart support ribs on either side of the open section. The support stand section also includes a ledge at the bottom, which forward edge of the ledge may be inserted in aligned support rib slots on either side of the opening, so that the copy holder may be inclined at different angles of inclination based upon the aligned slots selected to which the edge of the ledge of the support section legs is inserted.

The line guide employed with the copy holder is formed of a plastic and has a screw-type document depth adjustment knob, so that the line guide may accommodate anything from a single page to pads of paper or printed material. The line guide may be turned, so that it can be quickly tilted away from the flat panel surface when it is not needed, or to be removed completely from the one or the other side of the flat panel. Optionally, the line guide may include a transverse guide of a transparent plastic material, and typically may also include a curved, flat-bottom, transparent blade to magnify copy for easier reading. Thus the document copy holder goes from a non-use, compact, easily assembled position to a fully assembled use position, and is designed to reduce eye fatigue, speed data entry and improve productivity of the user.

The document copy holder includes a top surface on the top of the panel stand which is adapted in one embodiment to receive a document holder clip, such as, for example, but not limited to, a plastic document holder clip as described in U.S. Pat. No. 4,902,078 issued Feb. 20, 1990, hereby incorporated by reference. The document holder clip may be secured in the central position, or preferably mounted on a reverse t-shaped flange element having one and the other end, with slightly raised flanged elements extending outwardly from the front and rear surfaces and upwardly substantially the length of the top surface of the panel stand, and slightly below the upper edge of either side of the arm so that the clip, when in use, may be slipped on by the user and slidably adjusted as desired.

A document copy holder of the invention will be described for the purposes of illustration only in connection with certain embodiments; however, it is recognized that various changes, corrections, additions, modifications and improvements may be made to the illustrated embodiments by persons skilled in the art all falling within the spirit and scope of the invention.

DESCRIPTION OF THE EMBODIMENTS

Figure 1:
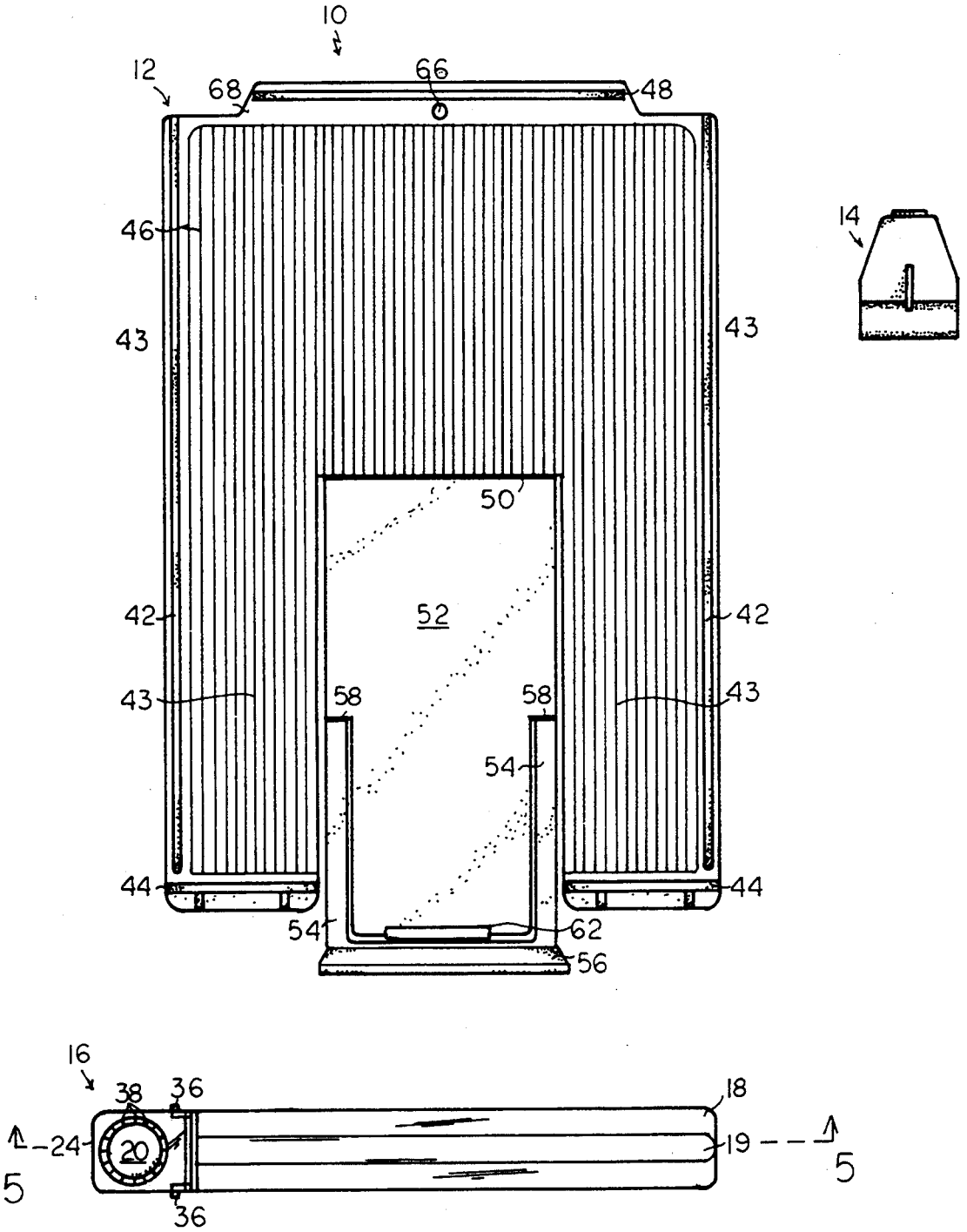
FIG. 1 is a front plan view of the three component parts of the document holder clip of the invention.

With reference to the drawings, there is shown and illustrated a document copy holder 12, document holder and line guide 16 and a document holder clip 14 of the invention 10 in a non-use, preassembled position. The copy holder panel stand 12 has a flat, rectangular panel surface with a molded pattern 46 to aid in securing the documents, and a ridge 68 extending upwardly from the upper edge of the panel stand, the ridge having a t-shaped flanged element 48 parallel to the top surface of the panel stand so that the clip 14 may be attached in a slidable manner by the user and adjusted as desired. Along either side of the panel stand are longitudinal grooves 42 to provide for positioning in a slidable manner the document line guide 16 (see FIG. 9). The copy holder panel stand 12 has two integral support legs 43 on either side with ledges 44 extending outwardly from the bottom of and perpendicular to the support legs to provide support for documents inserted into the copy holder. A support section 52 is cut out from the panel stand and positioned between the integral support legs 43, the support section having a living plastic hinge 50 extending across the top of the section to enable the support section to extend outwardly to the rear of the panel stand at an inclined angle. Two smaller support legs 54 are cut out of either side of the support section 52, and are hingeably connected to the support section by living plastic hinges 58, to enable the support legs to be positioned in an opposing manner to the support section 52 and connected by a support ledge 56 which can then be inserted into one of several opening slots 60 on either side of the back surface of the panel stand, to provide for a selected, inclined use position for the document copy holder. An anti-skid pad 62 is affixed to the bottom edge of the support section 52 to provide for non-skid positioning of the holder on a work surface.

The document clip holder 14 is positioned slidably along the top of the panel stand 12 by means of the flanged element 48 on the upper ridge 68. A circular hole 66 in the center of the top portion of the panel stand provides for easy storage and display of the preassembled unit.

The line guide holder 16 is comprised of a screw-type mechanism, with the screw top 20 and ridges 38 alongside for gripping by fingers to turn the screw top to adjust the line guide arm 18 in relation to the line guide body 24. The line guide body 24 is secured onto the panel stand 12 by means of tabs 26, 34 and 36 (see FIGS. 7, 8 and 9) extending from the surface of the line guide body and allow the positioning of the line guide arm 18 to retain documents or to magnify them as desired by positioning the magnifying portion 19 over a line or lines of copy.

Figure 2:
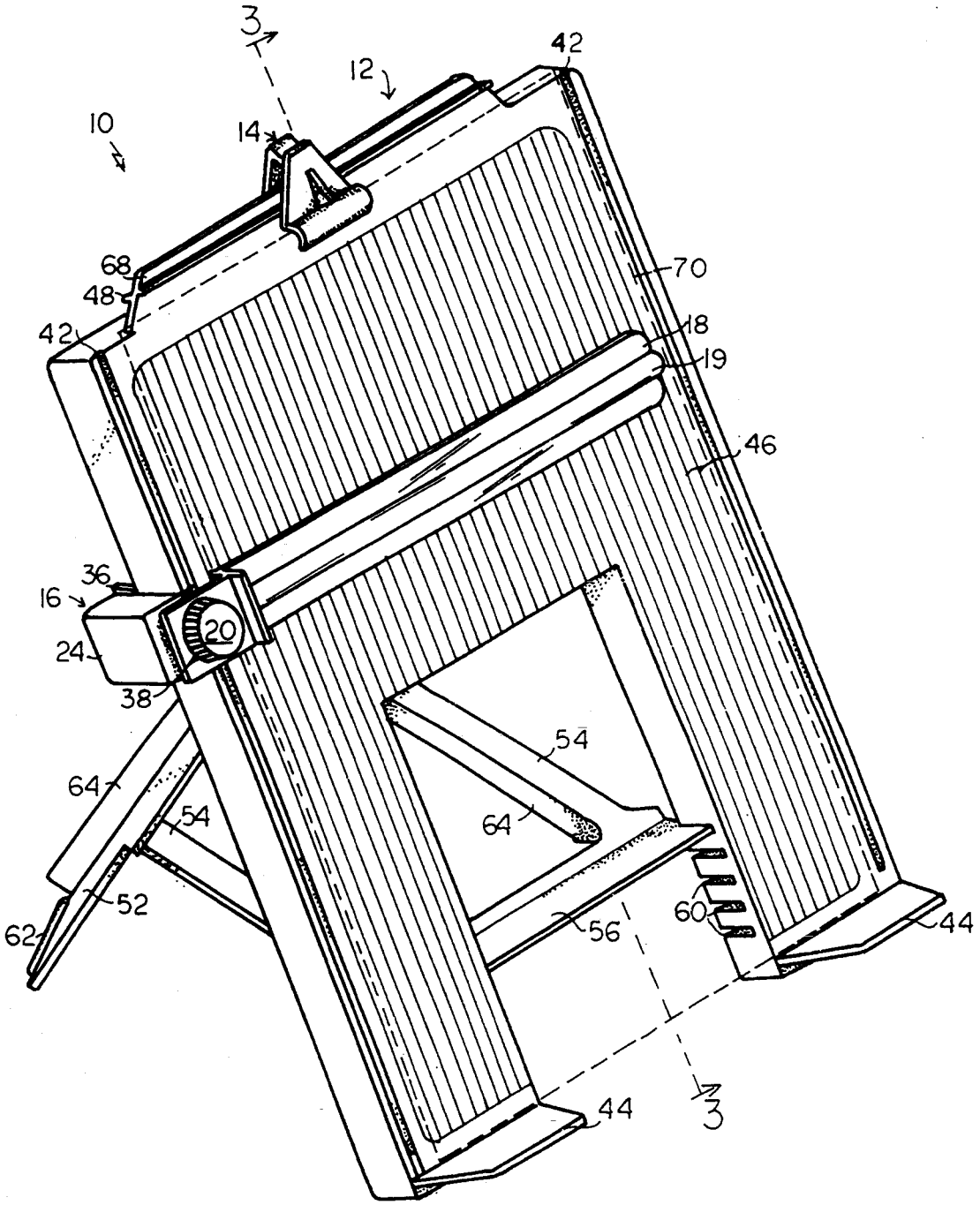
FIG. 2 is a perspective view from above of the front surface of the document copy holder in a use position with the copy holder line guide and document holder clip.

FIG. 2 illustrates the document copy holder of the invention in an inclined use position with a document 70 shown in dotted lines for purposes of illustration. The document clip 14 at the top of the copy holder 12 retains the document, and the line guide 16 and lower ledges 44 further retain and support the document. The line guide body 24 is slidably positioned in either of the grooves 42 on the panel stand 12 by means of guide base tabs 24, 34 and 36, which are slidably, snug-fit into the grooves (see FIGS. 7, 8 and 9). The hingeably attached support section 52 is positioned outwardly toward the back surface of the panel stand 12 to provide an inclined use angle for the panel stand, and is positioned by the insertion of the connecting ledge 56, which connects the small support legs 54, into one of the ledge slots 60. Back ridge support 64 provides strength to the support section 52, and anti-skid pad 62 prevents slippage of the copy holder in use.

Figure 3:
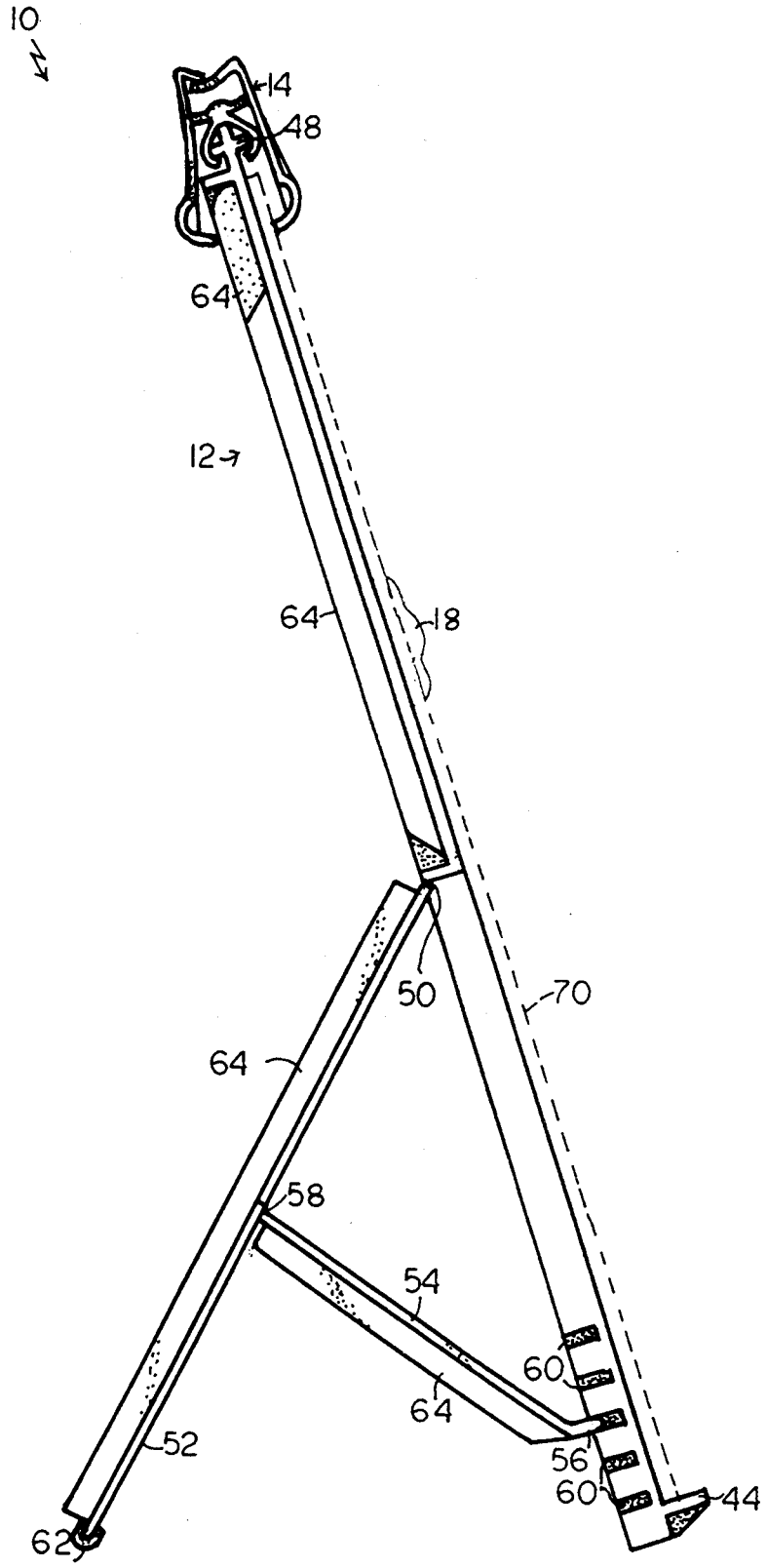
FIG. 3 is a side sectional view of the document holder of FIG. 2 along the lines of 3—3.

FIG. 3 shows a side sectional view of the document copy holder in a use position, with document clip 14 positioned at the top of the stand, secured over t-shaped flanged element 48, the panel stand surface positioned at an incline created by the outwardly extending support section 52 and the inwardly positioned small support legs 54 with ledge 56 inserted into ledge slots 60. A document 70 is shown in dotted lines being retained by the document clip 14, the line guide 16, and supported by the lower ledge 44. Back support ridges 64 located on support section 52, support legs 54 and panel stand 12 provide additional strength to the copy holder.

Figure 4:
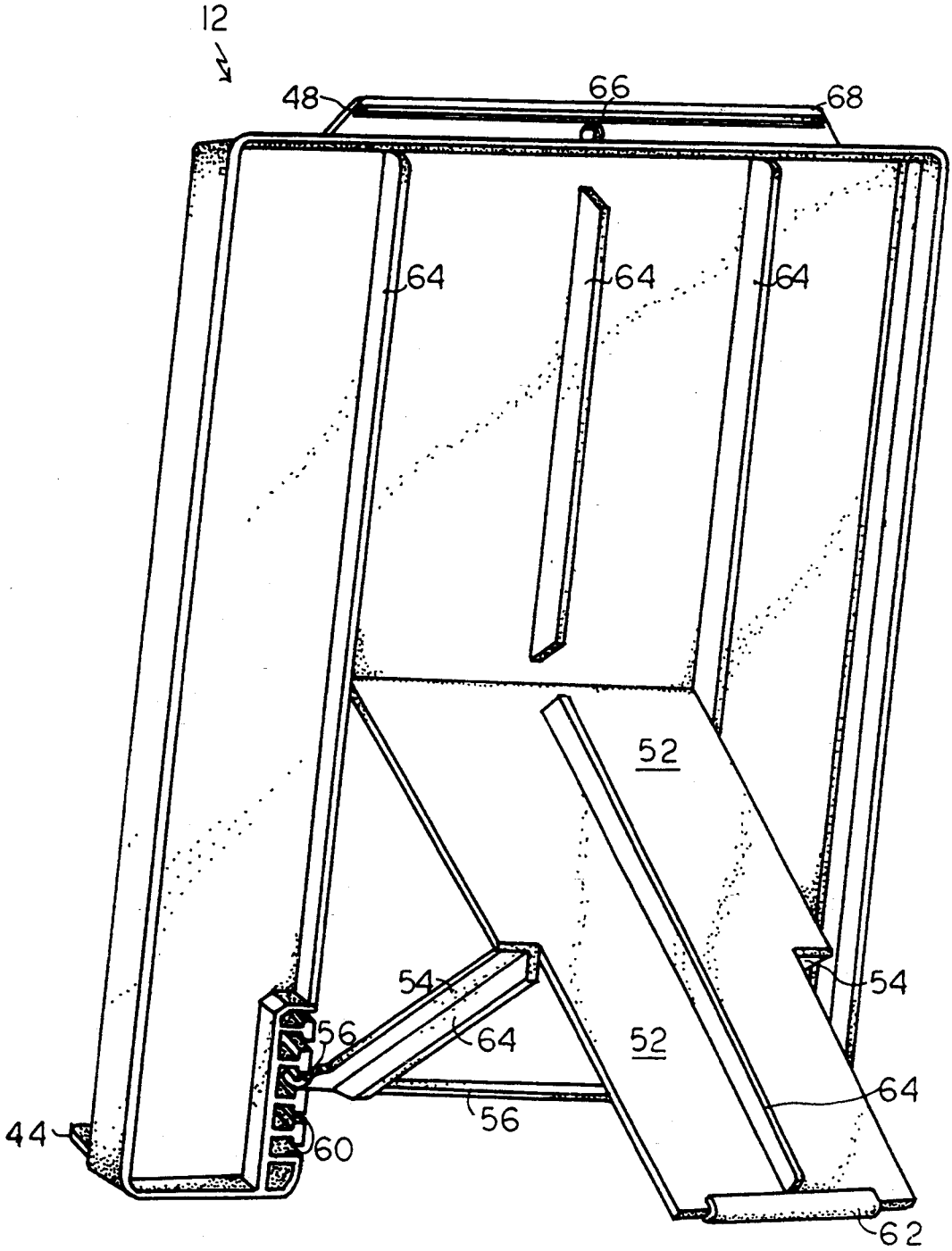
FIG. 4 is a perspective view of the back surface of the document holder of the invention without the document line guide and document holder clip.

FIG. 4 further depicts the back surface of the document copy holder 10 of the invention, with support ridges 64, support section 52 and small support legs 54. The connecting ledge 56 is inserted into aligned slots 60 to secure the support section.

Figure 5:
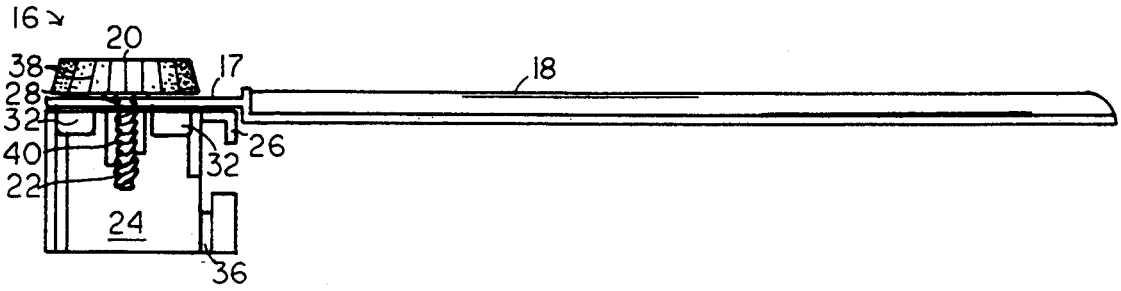
FIG. 5 is a side sectional view along line 5—5 of the line guide as illustrated in FIG. 1.
Figure 6:
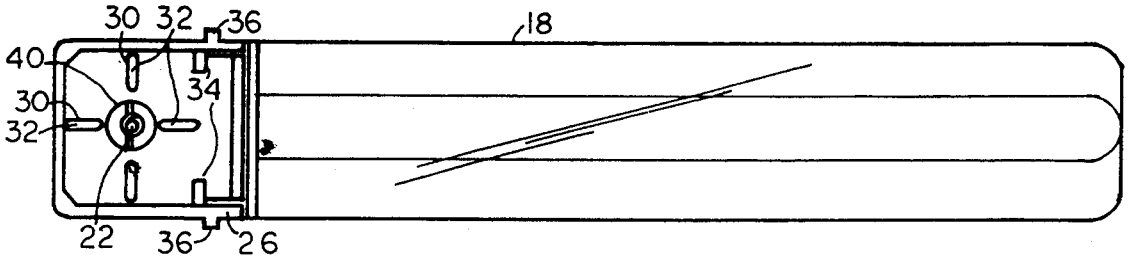
FIG. 6 is a bottom plan view of the line guide as shown in FIG. 1.
Figure 7:
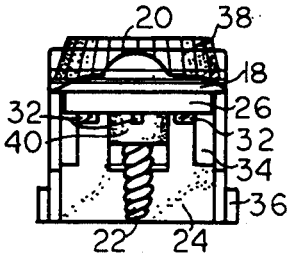
FIG. 7 is a front plan view of the line guide as shown in FIG. 1 in a retracted, document-retaining position.
Figure 8:
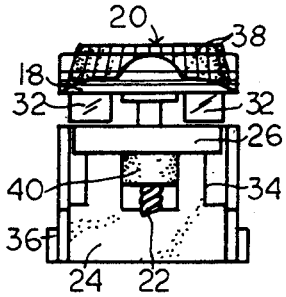
FIG. 8 is a front plan view of the line guide as shown in FIG. 1 in a rotated, upwardly turned non-use position.

FIGS. 5–8 illustrate the document line guide of the invention, with FIG. 5 being a side sectional view showing the screw top 20, screw top ridges 38 and screw 22 inserted in screw hole 28 and secured by the screw bolt mechanism 40. This mechanism enables the line guide arm 18 and line guide arm base 17 to be lifted by the turning of the screw to adjust the depth of the line guide. Tabs 32, extending downwardly from the line guide arm base 17, are inserted into tab slots 30 in the line guide body 24 are also lifted by the screw mechanism to provide for turning of the line guide arm when the screw is turned a sufficient amount, lifting the line guide arm away from the line guide body. As illustrated in FIG. 7, the screw top and line guide arm base are adjacent the line guide body, and in FIG. 8 the screw top is unscrewed to lift the line guide arm away from the line guide body, freeing the line guide tabs 32 of the slots 30 in the line guide body. In this position, the line guide arm 18 may be move at the discretion of the user.

Figure 9:
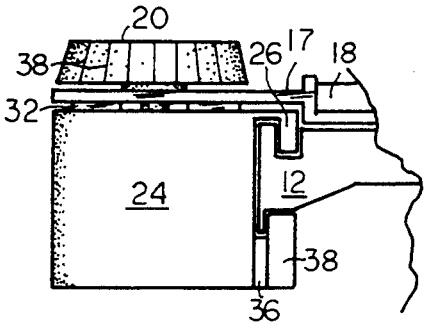
FIG. 9 is an enlarged, cut away, plan view of the line guide body in position on the document copy holder.

FIG. 5 further illustrates the guide base inner tabs 34, the line guide outer tabs 36 and the line guide base rib 26, which are positioned for the slidable attachment of the line guide body to the grooves 42 in the panel stand 12. FIG. 9 is a detailed, enlarged, fragmentary plan illustration of the side of the line guide body secured in a slidable, snug-fit manner to the panel stand 12.

What is claimed is:

1. A document copy holder for holding documents, which holder comprises:

a) a generally flat, display panel stand composed of a plastic material, having a face and back surface, a top and bottom and sides and of a selected height and width to hold a selected document on the face surface;

b) the panel stand adapted to move between a compact, non-use position and an inclined, supported position in use to hold a document on the face surface;

c) a clip means to retain documents on the face surface of the panel stand;

d) a line guide means attached to one or the other side of the panel stand and having a line guide extending generally transversely across the face surface of the panel stand and adapted to be moved slidably by a user between the top and bottom with respect to lines on the held document;

e) ledge means extending outwardly from the bottom of the panel stand;

f) a separate, support stand means which in the compact, non-use position is generally aligned with and positioned in an opening on the face surface of the panel stand, which is secured to the panel stand by a hinge, the hinge formed by a plastic material to provide for the hinged movement of the support means between a non-use, compact position generally aligned with the face surface of the panel stand, and a hinged, use position extending outwardly from the back surface of the panel stand;

g) leg support means hingedly connected on either side of the support stand means and adapted to move between the non-use position of the support stand means and a support use position wherein the leg support means extends outwardly from the backward extending support stand means in use and toward the back surface of the panel stand, to provide with the support stand means support to the inclined use position of the panel stand; and h) means to retain the leg support means to the back of the panel stand in a selected support use position.

2. The holder of claim 1 which includes a flanged element extending across the top surface of the panel stand and wherein the clip means is adapted to be slidably mounted on the flanged element a selected document position.

3. The holder of claim 1 wherein the line guide means includes a generally transparent, magnifying line guide extending transversely across the face surface of the panel stand.

4. The holder of claim 1 wherein the line guide means comprises a base adapted to be slidably connected to one or the other side and wherein the line guide extending transversely across the base surface of the panel stand is secured at one end to the base by a knob threadably secured to the base and adapted for movement between a holding position to hold the line guide in position and against a document and a release position wherein the line guide may be pivotably moved to a non-use position.

5. The holder of claim 1 wherein the ledge means extends outwardly a short distance on either side of the opening in the panel stand.

6. The holder of claim 1 wherein the support stand means has a top, bottom and sides and is generally rectangular and includes a plastic, hinged support section and spaced-apart, separately plastic hinged at one end support legs, each having a one and other end, on either side of the support section, the panel containing at least one slot on each side of the support stand and in the panel stand to receive the other end of the support legs to retain the support legs with the support stand in a selected inclined support position.

7. The holder of claim 6 wherein the panel includes a plurality of spaced-apart vertically positioned slots on either side of the back surface of the panel stand to provide for the selected insertion of the other end of each leg support by an aligned slot to position the panel stand at a selected angle of inclination from the vertical in use.

8. The holder of claim 6 wherein the outer end of the support legs are joined together with a horizontal rib element having an edge, which edge is adapted to be inserted into the slots in use.

9. The holder of claim 6 wherein the face surface of the panel stand has a textured document retaining surface.

10. The holder of claim 6 wherein the panel stand has longitudinal grooves on each side extending generally from the top to the bottom for the slidable insertion of the line guide means.

11. The holder of claim 6 wherein the hinges of the support stand means and support leg means are plastic hinges formed during molding from the plastic material of the panel stand.

12. The holder of claim 6 wherein the rib element includes anti-skid feet on the other end to retain the support stand means in position on a work surface.

13. The holder of claim 6 wherein the line guide means includes a slidably mounted guide body having a face surface with a threaded hole therein and a plurality of spaced-apart slots in the face surface, and a line guide for printed material having a one and other end, and a plurality of raised fingers at the other end and adapted to fit within the said slots; and a knob with a threaded shaft extending through the one end of the line guide and adapted to be received in said threaded hole, whereby the line guide may be secured in a use position or on rotation of the knob may be moved to a non-use position.

14. The line guide means of claim 13 wherein the line guide means, on rotation of the knob in a use position, allows for the insertion of one or more documents of varying thickness under the line guide.

15. The holder of claim 1 wherein the support stand means is generally rectangular and extends slightly outwardly in the compact, non-use position from the bottom of the panel stand.

16. The copyholder of claim 1 which includes a hole formed at the center and top of the panel stand for display purposes in a non-use position.

17. A document copy holder for holding documents, which holder comprises:

a) a generally flat, display panel stand composed of a plastic material, having a face and back surface, a top and bottom and sides and of a selected height and width to hold a selected document on the face surface;

b) the panel stand adapted to move between a compact, non-use position and an inclined, supported position in use to hold a document on the face surface;

c) a clip means to retain documents on the face surface of the panel stand;

d) a flanged element extending across the top surface of the panel stand and wherein the clip means is adapted to be slidably mounted on the flanged element to a selected document retaining position;

e) a line guide means attached to one or the other side of the panel stand and having a line guide extending generally transversely across the face surface of the panel stand and adapted to be moved slidably by a user between the top and bottom with respect to lines on the held document;

f) a line guide body comprising a base adapted to be slidably connected to one or the other side of the panel stand and wherein the line guide extending transversely across the base surface of the panel stand is secured at one end to the base by a knob threadably secured to the base and adapted for movement between a holding position to hold the line guide in position and against a document and a release position wherein the line guide may be pivotably moved to a non-use position;

g) ledge means extending outwardly a short distance on either side of the opening in the panel stand;

h) a separate, support stand means which in the compact, non-use position is generally aligned with and positioned in an opening on the face surface of the panel stand, which is secured to the panel stand by a hinge, the hinge formed by a plastic material to provide for the hinged movement of the support means between a non-use, compact position generally aligned with the face surface of the panel stand, and a hinged, use position extending outwardly from the back surface of the panel stand;

i) leg support means hingedly connected on either side of the support stand means and adapted to move between the non-use position of the support stand means and a support use position wherein the leg support means extends outwardly from the backward extending support stand means in use and toward the back surface of the panel stand, to provide with the support stand means support to the inclined use position of the panel stand; and j) the hinges of the support stand means and support leg means having plastic hinges formed during molding from the plastic material of the panel stand;

k) a panel including a plurality of spaced-apart vertically positioned slots on either side of the back surface of the panel stand to provide for the selected insertion of the other end of each leg support by an aligned slot to position the panel stand at a selected angle of inclination from the vertical in use; and l) means to retain the leg support means to the back of the panel stand in a selected support use position.

* * * * *